United States Patent [19]

Domelsmith et al.

[11] Patent Number: 4,832,751

[45] Date of Patent: May 23, 1989

[54] METHOD FOR REDUCTION OF ENDOTOXIN IN COTTON LINT OR DUST

[75] Inventors: Linda N. Domelsmith; Marie-Alice Rousselle; Ralph J. Berni, all of Metairie, La.

[73] Assignee: The United States of America as represented by the Secretary of Agriculture, Washington, D.C.

[21] Appl. No.: 274,721

[22] Filed: Nov. 4, 1988

Related U.S. Application Data

[63] Continuation of Ser. No. 68,497, Jul. 1, 1987, abandoned.

[51] Int. Cl.[4] ..... B08B 3/00

[52] U.S. Cl. ..... 134/28; 134/29; 134/42

[58] Field of Search ..... 134/28, 29, 42

[56] References Cited

PUBLICATIONS

Chemical Abstract 99:43.600g (1983).

*Primary Examiner*—Asok Pal
*Attorney, Agent, or Firm*—M. Howard Silverstein; Raymond C. Von Bodunger

[57] ABSTRACT

A method for reducing endotoxin in cotten fiber or dust is disclosed. Cotton fiber or dust is detoxified in a solution selected from the group consisting of 95% ethanol and hydrochloric acid; 95% ethanol and sodium hydroxide; and dimethylsulfoxide.

10 Claims, No Drawings

METHOD FOR REDUCTION OF ENDOTOXIN IN COTTON LINT OR DUST

This application is a continuation of application Ser. No. 68,497, filed July 1, 1987, now abandoned.

BACKGROUND OF THE INVENTION (1) Field of the Invention

This invention relates to a method for eliminating endotoxins from raw cotton.

(2) Description of the Prior Art

Endotoxins, characteristic components of the cell wall of gram-negative bacteria, have been found in cotton fiber and plant parts, as well as in the atmosphere of textile mills processing cotton fibers. These endotoxins have been implicated as a causative of byssinosis, a lung disease found in some cotton textile workers.

Water-washing under relatively severe processing conditions has been used to reduce endotoxin in cotton lint but this causes serious problems in the ultimate processing of the cotton to manufacture yarns and fabrics.

In medical practices, high temperatures are used to destroy endotoxins on glassware and medical equipment; however, at these temperatures, cotton lint readily degrades.

SUMMARY OF THE INVENTION

This invention provides methods for effectively eliminating endotoxin from raw cotton without detrimental effects in the processing of the fiber into yarns and fabric.

In these processes for effectively eliminating endotoxin from raw cotton, cotton lint or dust is treated with one of the following solvents, neat or containing acid or base at moderate temperature, namely: ethanol containing sodium hydroxide, ethanol containing hydrochloric acid and dimethylsulfoxide. The solvents are then removed from the raw cotton.

The primary object of this invention is to provide a process for eliminating endotoxin, a suspected causative agent of byssinosis, from raw cotton fiber without decreasing the processability of the fiber into yarns and fabrics.

A second object of the present invention is to provide a process for eliminating endotoxin from raw cotton that utilizes azeotropic solvents that can be recycled to make the process more economical by avoiding large replacement of solvents.

A third object is to provide a process for eliminating endotoxin from raw cotton that utilizes a solvent (ethanol) with a high vapor pressure at room temperature to furnish dry cotton in a short time with little expenditure for drying energy.

A fourth object of the present invention is to provide a process for eliminating endotoxin from raw cotton that utilizes chemicals that are ordinarily used in commerce, thus avoiding exotic handling, and chemicals that can be obtained from farm commodities such as ethanol.

DESCRIPTION OF THE PREFERRED EMBODIMENTS

The preferred embodiment of this invention is applicable to raw cotton or cotton dust amd is based on the discovery that endotoxin molecules contain active groups that can be deactivated by deesterification of their long chain fatty acid groups or phosphate moieties. Endotoxins, which are found in the cell walls of gram negative bacteria, consist of a heteropolysaccharide component and a covalently bound lipid component. The lipid component is responsible for the endotoxic properties. The lipid moiety is attached through several common organic functionalities: these include carbon ester, phosphate ester, and amide linkages. Some reagents that attack these functionalities or solvate the whole molecule can be used to "detoxify" raw cotton or cotton dust.

Cotton lint or dust is immersed in one of the following solvents (with or without additives) which are effective for detoxifying raw cotton or cotton dust: 95% ethyl alcohol containing sodium hydroxide, or (2) 95% ethyl alcohol containing hydrochloric acid, or (3) dimethylsulfoxide. The solvent is then removed from the cotton by any satisfactory means, such as filtration, centrifugation, etc.

The cotton is then rinsed with neat solvent and allowed to air dry.

The treatments described effectively eliminate endotoxins from the fiber or dust as measured by Limulus Amoebocyte Lysate gelation.

95% ethyl alcohol is used because it is an azeotrop and can be recycled. It is also economically available as a commercial 95% grade.

An effective range of 95% alcohol to sodium hydroxide or hydrochloric acid is 270–400: 1. Effective range of temperature is 60° to 80° C.

Ratio of dimethylsulfoxide to cotton is 30–100:1 on a wt basis.

EXAMPLE 1

A ten gram sample of cotton was immersed in 500 ml of 95% ethyl alcohol containing 1.0 g sodium hydroxide that had been heated to 60° C. The cotton remained in the solvent for one hour, then the solvent was removed from the cotton sample by vacuum filtration. The cotton sample was then rinsed with an additional 500 ml of neat solvent and allowed to air dry. The results of the Limulus Lysate Gelation test were as follows: Endotoxin in ppm was 1.0 which was 11% of the original value for the untreated cotton.

EXAMPLE 2

A ten gram sample of cotton dust was immersed in 500 mL. of 95% ethyl alcohol containing 1.0 g. sodium hydroxide that had been heated to 60° C. The dust remained in the solvent for one hour, then was filtered through a buchner funnel to remove excess solvent. The dust sample was then rinsed with an additional 500 ml of neat solvent and allowed to air dry. The results of the Limulus Lysate Gelation test were as follows: Endotoxin in ppm was 29, which was 14% of the original value for the untreated dust. This compared with endotoxin value of 112, which was 55% of the untreated control when 100% ethyl alcohol was used as the treating agent; an endotoxin value of 136 ppm, which was 66% of the untreated control was obtained when 95% ethyl alcohol was used as the treating agent.

EXAMPLE 3

A ten gram sample of cotton was treated as in Example 1 with the use of 2.7 g. of concentrated hydrochloric acid in place of sodium hydroxide. Endotoxin value obtained was 31 ppm, which was 15% of the untreated control.

EXAMPLE 4

A ten gram sample of cotton was treated as in Example 1 except 500 ml dimethylsulfoxide was substituted for the ethyl alcohol sodium hydroxide solution. After filtration, the sample was dried in vacuo at 30 millitorr. Endotoxin value obtained was 20 ppm, which was 5% of the untreated control.

We claim:

1. A method for detoxifying raw cotton fiber without decreasing the processability of said fiber into yarns and fabrics comprising treating said fiber in a solution selected from the group consisting of: ethanol and sodium hydroxide, and dimethylsulfoxide.

2. The process of claim 1 wherein said solution is ethanol and sodium hydroxide.

3. The method of claim 2 wherein the ethanol is 95% ethanol.

4. The method of claim 3 wherein the solution is 95% ethanol and sodium hydroxide in proportions of from about 270–400: 1 ethanol to sodium hydroxide and the temperature is from about 60° to 80° C.

5. The process of claim 1 further comprising processing said fiber into yarns after said detoxifying step.

6. The process of claim 3 further comprising processing said fiber into yarns after said detoxifying step.

7. The process of claim 4 further comprising processing said fiber into yarns after said detoxifying step.

8. The process of claim 2 further comprising processing said fiber into yarns after said detoxifying step.

9. A method for detoxifying cotton fiber comprising treating said fiber in a solution of dimethylsulfoxide in proportions of from about 30: 100: 1 dimethylsulfoxide to cotton and the temperature is from about 60° to 80° C.

10. The process of claim 9 further comprising processing said fiber into yarns after said detoxifying step.

* * * * *